US005134738A

United States Patent [19]

Hatfield

[11] Patent Number: 5,134,738

[45] Date of Patent: Aug. 4, 1992

[54] STRETCHER FOR USE IN MINES

[75] Inventor: Sidney Hatfield, St. Louis, Mo.

[73] Assignee: Peabody Coal Company, St. Louis, Mo.

[21] Appl. No.: 653,663

[22] Filed: Feb. 8, 1991

[51] Int. Cl.[5] ..... A61G 1/00

[52] U.S. Cl. ..... 5/625; 198/735.1; 299/12; 299/43; 5/81.1

[58] Field of Search ..... 5/82, 81 R, 81 B, 81 C; 198/735.1; 299/12, 43; 104/245, 247; 196/20

[56] References Cited

U.S. PATENT DOCUMENTS

| | | | |
|---|---|---|---|
| 2,141,100 | 12/1938 | Warden | 5/82 |
| 2,972,755 | 2/1961 | Abel | 5/82 |
| 3,158,875 | 12/1964 | Fletcher | 5/82 |
| 4,037,871 | 7/1977 | Bourgraf et al. | 296/20 |
| 4,087,030 | 5/1978 | Knight | 224/6 |
| 4,259,756 | 4/1981 | Pace | 5/81 B |
| 4,269,304 | 5/1981 | Braun | 198/735.1 |
| 4,286,740 | 9/1981 | Knight | 224/157 |
| 4,480,345 | 11/1984 | Dunn | 5/82 |
| 4,485,504 | 12/1984 | Lehmann | 5/82 R |
| 4,579,381 | 4/1986 | Williams | 296/20 |
| 4,639,955 | 2/1987 | Corminati | 5/81 B |
| 4,670,921 | 6/1987 | Avni et al. | 5/82 R |
| 4,685,161 | 8/1987 | Zalman | 5/82 R |
| 4,744,116 | 5/1988 | Shirazi | 5/82 R |

FOREIGN PATENT DOCUMENTS

| | | | |
|---|---|---|---|
| 1566432 | 2/1970 | Fed. Rep. of Germany | 5/82 |
| 1033779 | 8/1983 | U.S.S.R. | 299/12 |
| 129054 | 7/1919 | United Kingdom | 296/20 |

*Primary Examiner*—Renee S. Luebke
*Assistant Examiner*—F. Saether
*Attorney, Agent, or Firm*—Senniger, Powers, Leavitt & Roedel

[57] ABSTRACT

A stretcher for use in confined areas such as a mine tunnel for transporting sick or injured persons which is constructed for mounting on sideboard structure of a conveyor in the mine tunnel. The stretcher includes a frame having a generally flat portion for supporting the sick or injured person on the stretcher. Rollers mounted on the frame for rolling engagement with the sideboard structure support the frame on the sideboard structure so that the structure may move translationally over the sideboard stretcher. Guide rollers maintain the rollers in engagement with the sideboard structure.

12 Claims, 2 Drawing Sheets

STRETCHER FOR USE IN MINES

BACKGROUND OF THE INVENTION

This invention relates generally to stretchers for transporting sick or injured persons and more particularly to a stretcher for use in a mine.

A miner injured in a mine tunnel must be transported out of the tunnel to receive treatment. The tunnels are typically so small and filled with mining equipment that an average sized man cannot stand fully erect. The equipment in the tunnel, such as a mining machine, a conveyor for transporting the coal and mine wall support structure, obstructs walkways requiring one to step over this equipment while walking through the tunnel. Thus, a normal stretcher or gurney is unacceptable for transporting sick or injured persons in the tunnel because it must be lifted over the obstructions as the persons carrying the stretcher themselves negotiate the obstructions. Lifting the stretcher over the obstructions is made more difficult by the confined space in the tunnel. Depending upon the specific injury, it may be very detrimental to jostle the injured person as he is being transported out of the tunnel. Therefore, there is presently a need for a stretcher which allows a sick or injured person in a mine to be smoothly transported out of the mine with a minimum of effort.

SUMMARY OF THE INVENTION

Among the several objects and features of the present invention may be noted the provision of a stretcher which may transport a sick or injured person through a mine tunnel with little jostling; the provision of such a stretcher which can be moved through a tunnel with a minimum of effort and without regard to obstructions in the mine; the provision of such a stretcher which is cooperatively interengageable with equipment in the mine; and the provision of such a stretcher which is simple in design and of sturdy construction.

Generally, a stretcher for use in confined areas such as a mine tunnel for transporting sick or injured persons. The stretcher is constructed for mounting on sideboard members of a conveyor structure in the mine tunnel. The stretcher comprises a frame including a generally flat portion for supporting the sick or injured person on the stretcher. Roller means mounted on the frame is provided for rolling engagement with two of said sideboard members to support the frame on said sideboard members so that the stretcher may move translationally over the sideboard members, and retainer means maintains the roller means in engagement with said sideboard members.

In another aspect of the present invention, a stretcher of the same general type as described above in combination with a conveyor is disclosed.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

In longwall mining, at least three entry tunnels are bored generally horizontally into the area to be mined, such as the side of a mountain. Each entry tunnel extends about 6,000 feet into the mountainside and is spaced from the next adjacent entry tunnel approximately 550–700 feet. At about 100 foot intervals into the entry tunnels, cross cut tunnels are made which connect all three entry shafts. The cross cut tunnel is typically referred to as a longwall section. Typically, only the rightmost of the three tunnels is used for transporting persons and coal into and out of the mine. A mining machine (not shown), such as the 4LS Shearer mining machine manufactured by Joy Manufacturing Company of Franklin, Pa., is set up to travel along the longwall section, cutting coal away from a side wall of the longwall section as it travels. The mining machine typically straddles a conveyor (indicated generally at 10 in FIG. 1), such as face conveyor model number DMKF3-E74V manufactured by Haldach and Braun of Germany and available in the United States through its subsidiary in Washington, Pennsylvania. Coal torn away from the longwall section wall falls onto the conveyor 10 and is transported to a belt (not shown) in the rightmost entry tunnel for transportation out of the mine. The portion of the longwall section floor not occupied with the mining machine or conveyor has large hydraulic jacks (not shown) used to support the walls of the longwall section. Moreover, the longwall section often has a lot of coal on its floor. Thus, persons who are injured or become ill in the longwall section may have to be moved as much as 1,400 feet over many obstructions before reaching the entry tunnel where transportation out of the mine is readily available.

Figure 1:
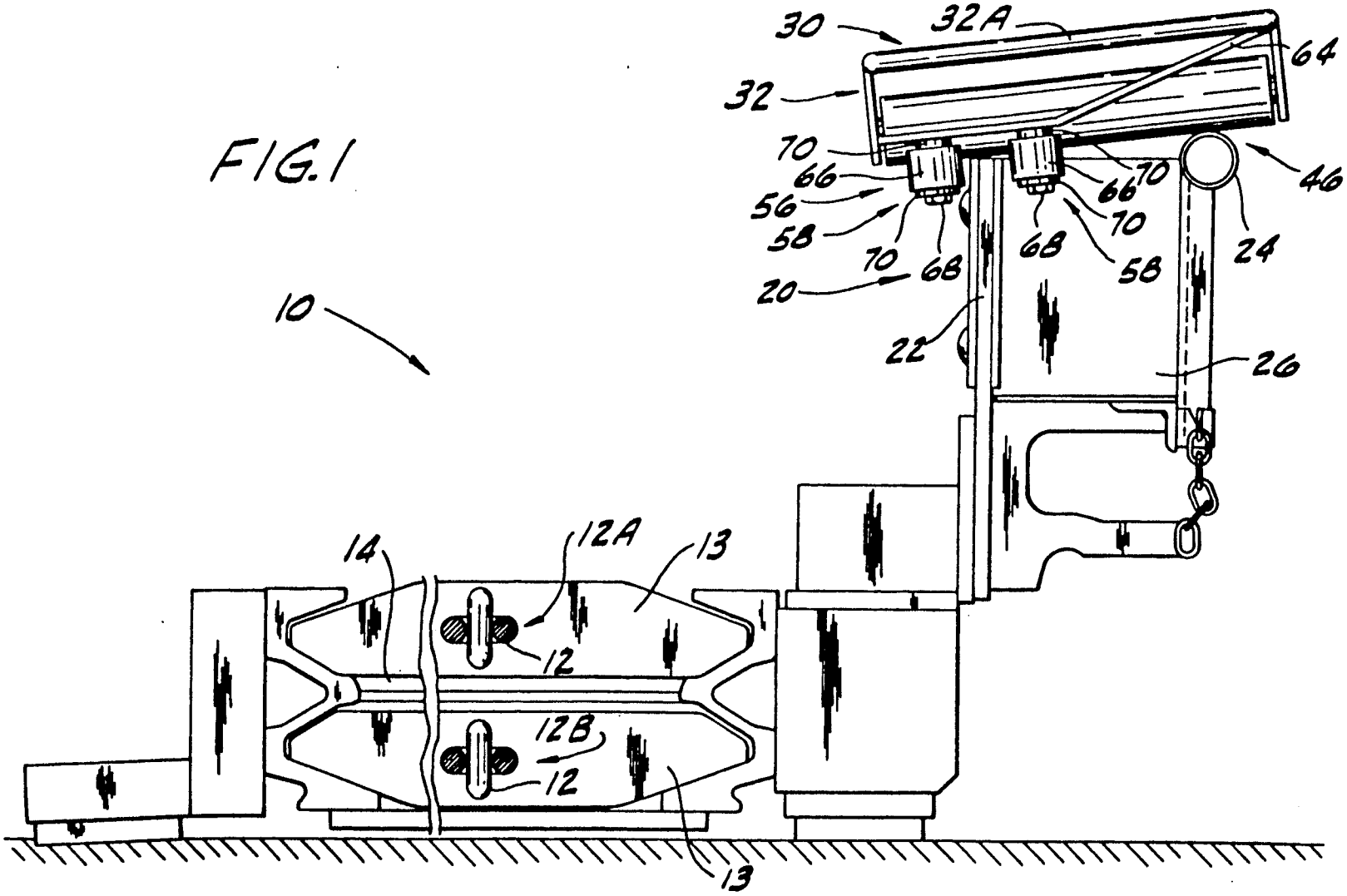
FIG. 1 shows an end elevation of a conveyor with a stretcher constructed according to the principles of the present invention supported thereon.

The conveyor 10 includes parallel moving conveyor chains 12 (only one of which is shown in FIG. 1) having upper and lower reaches, indicated at 12A and 12B, respectively, for transporting the coal to a tunnel to a conveyor belt (not shown) in the entry tunnel for delivery out of the mine. The chains 12 advance transversely extending divider sections 13 spaced along the length of the chains which push the coal along a conveyor floor 14. The side of the conveyor 10 adjacent the wall of the longwall section being mined has no sideboard. Sideboard members 20 on the side of the conveyor 10 farthest away from the wall of the longwall section being mined include an inner sideboard 22, which retains the coal from moving over that side of the conveyor, and a railing 22. The inner sideboard 22 and the railing 24 are laterally spaced apart about 10 inches and extend parallel to the conveyor chains 12. Frame members 26 extend between and connect the inner sideboard 22 and the railing 24 at intervals along their length.

Figure 2:
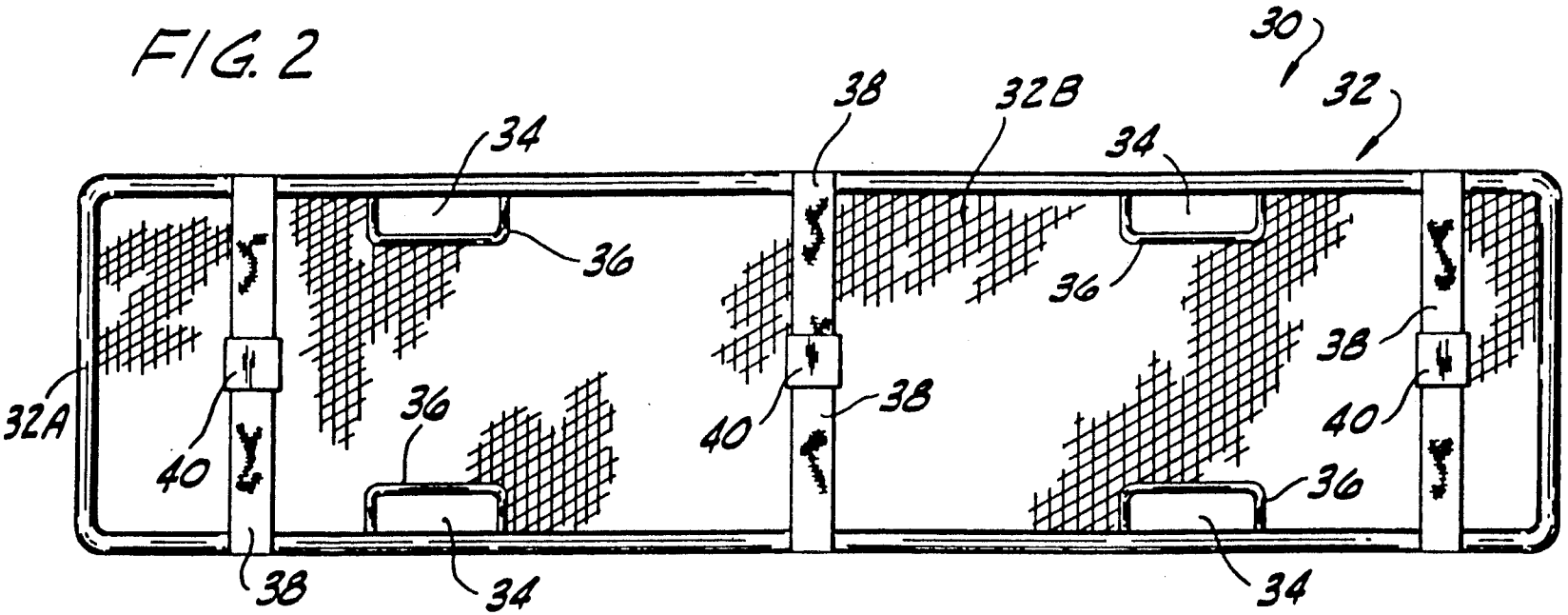
FIG. 2 is top plan view of the stretcher.
Figure 3:
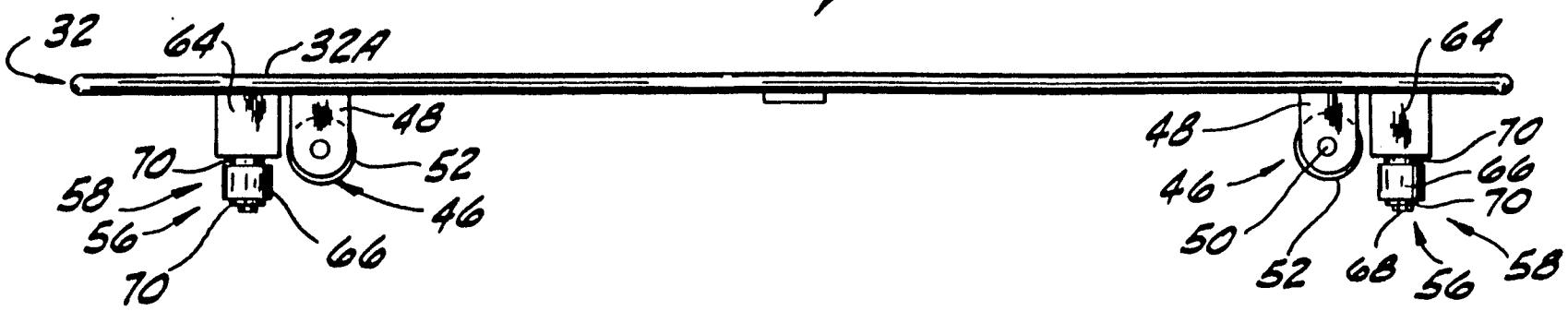
FIG. 3 is a side elevation of the stretcher.

A stretcher constructed according to the principles of the present invention which is for use in confined areas, such as the longwall section described, is generally indicated at 30. Although the stretcher 30 is particularly adapted for use with the conveyor for longwall coal mining of the type described, the principles of the present invention are applicable to other types of mining procedures and conveyors. As shown in FIG. 2, the stretcher 30 is constructed for mounting on the sideboard members 20 of the conveyor 10 in the longwall section. The stretcher 30 includes a frame 32 comprising a generally rectangular outer frame portion 32A made of metal pipe and welded together, and a flat portion 32B made of expanded sheet metal and mounted on the outer frame portion 32A to provide a surface for supporting a sick or injured person. Two pairs of openings 34 in the flat portion 32B, the pairs being longitudinally spaced apart, provide hand grips for gripping and carrying the stretcher when it is not engaged on the conveyor 10. The margins of the flat portion 32B of the frame surrounding the grip openings 34 are reinforced on three sides by a frame member 36 which is attached to the flat portion and the outer portion 32A of the frame. In this embodiment, the frame member 36 is made of segments of metal pipe having a smaller diameter than the pipe used for the outer portion 32A of the frame. The metal pipe is welded together to form the frame member 36. Three sets of straps 38 having buckles 40 are spaced longitudinally of each other over the flat portion 32B of the frame for securing the sick or injured person's body to the stretcher 30.

A pair of cylindrical rollers 46 (broadly, "roller means") with roll axes extending generally laterally of the stretcher frame 32 are adapted for rolling engagement with the inner sideboard 22 and the railing 24. As shown in FIG. 1, each roller spans the separation between the inner sideboard 22 and railing 24 and rests on top of these two sideboard members 20. The rollers 46 allow the stretcher to roll translationally over the inner sideboard 22 and railing 24 for moving the sick or injured person along the longwall section to the entry tunnel for transportation out of the mine. The rollers 46 are mounted for rotation at opposing longitudinal ends in tabs 48 depending from the outer frame portion 32A. In this embodiment, the tabs 48 are attached as by welding to the outer frame portion 32A. The rollers 46 each include an axle 50 fixedly mounted in an opening in the tabs 48, and a cylindrical roller member 52 supported by the axle for rotation with respect to the axle.

Retainer means, indicated generally at 56, restricts lateral motion of the stretcher 30 relative to the sideboard members 20 of the conveyor 10 to maintain the rollers in engagement with both the inner sideboard 22 and the railing 24. The retainer means 56 includes two pairs of longitudinally spaced guide rollers 58 (broadly "guide members"), with each guide roller having a generally vertically oriented roll axis. Each pair of guide rollers 58 are laterally spaced from each other with the space between the guide roller sized to receive an upper portion of the inner sideboard 22. As shown in FIG. 1, the guide rollers 58 are thereby positioned for rolling engagement with the sides of the inner sideboard 22 to retain the rollers 46 on the inner sideboard 22 and railing 24. That is, if the stretcher moves to the right, the outer guide rollers 58 of each pair of guide rollers will engage the inner sideboard 22 and stop the rightward movement. Similarly, leftward movement of the stretcher will be stopped by engagement of the inner guide roller 58 of each pair of guide rollers.

Two angled framepieces 64 mount respective pairs the guide rollers 58 on the frame 32. Each framepiece 64 is attached as by welding to laterally opposite sides of the outer frame portion 32A. The guide rollers 58 each include cylindrical roller members 66 which are connected to the framepiece 64 by a bolt 68. A pair of washers 70 separate the roller member 66 from the framepiece 64 and from the head of the bolt 68. The roller member may rotate with respect to the bolt 68 and stretcher frame 32 upon engagement with a side of the inner sideboard 22 so as not to impede the translational movement of the stretcher 30 over the sideboard members 20.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A stretcher for use in confined areas such as a mine tunnel for transporting sick or injured persons, the stretcher being constructed for mounting on sideboard members of a conveyor structure in the mine tunnel, the stretcher comprising a frame including a generally flat portion for supporting the sick or injured person on the stretcher, roller means mounted on the frame for rolling engagement with two of said sideboard members to support the frame on said sideboard members so that the stretcher may move translationally over the sideboard members, and retainer means structurally separate from said roller means for maintaining said roller means in engagement with said sideboard members, said retainer means comprising at least two generally horizontally spaced guide members depending from the frame, the generally horizontal space between the guide members being sized to receive an upper portion of only a single one of said sideboard members, the guide members being thereby positioned for engagement with said one sideboard member to retain said roller means in engagement with said sideboard members.

2. A stretcher as set forth in claim 1 wherein said guide members comprise guide rollers having generally vertically oriented roll axes, the guide rollers being laterally spaced apart on the stretcher frame.

3. A stretcher as set forth in claim 1 wherein said roller means comprises at least two rollers mounted for rotation on the stretcher frame in longitudinally spaced apart positions.

4. A stretcher for use in confined areas such as a mine tunnel for transporting sick or injured persons, the stretcher being constructed for mounting on sideboard members of a conveyor structure in the mine tunnel, the stretcher comprising a frame including a generally flat portion for supporting the sick or injured person on the stretcher, roller means mounted on the frame for rolling engagement with two of said sideboard members to support the frame on said sideboard members so that the stretcher may move translationally over the sideboard members, and retainer means structurally separate from said roller means for maintaining said roller means in engagement with said sideboard members, said retainer means comprising at least two generally horizontally spaced guide members depending from the frame, the generally horizontal space between of the guide rollers being sized to receive an upper portion of one of said sideboard members, the guide members being thereby positioned for engagement with said one sideboard member to retain said roller means in engagement with said sideboard members, wherein said roller means comprises at least two rollers mounted for rotation on the stretcher frame in longitudinally spaced apart positions, the rollers are generally cylindrical and have roll axes extending generally laterally of the stretcher frame, the rollers being mounted for rotation generally at each end on the frame, each roller being adapted to simultaneously engage said two sideboard members.

5. A stretcher as set forth in claim 4 wherein said flat portion of the frame comprises a generally rectangular piece of expanded metal mounted on remaining portions of the frame, and wherein the stretcher further comprises straps for securing the sick or injured person to the stretcher.

6. In combination, a conveyor of the type used in mine tunnels to transport material being mined, the conveyor including sideboard members extending generally lengthwise of the conveyor, and a stretcher comprising a frame including a generally flat portion for supporting the sick or injured person on the stretcher, roller means mounted on the frame for rolling engagement with two of said sideboard members to support the frame on said sideboard members so that the stretcher may move translationally over the sideboard members, and retainer means for maintaining said roller means in engagement with said sideboard members.

7. The combination as set forth in claim 6 wherein said retainer means comprises at least two generally horizontally spaced guide members depending from the frame, the generally horizontal space between the guide members being sized to receive an upper portion of one of said sideboard members, the guide members being thereby positioned for engagement with said one sideboard member to retain said roller means in engagement with said sideboard members.

8. The combination as set forth in claim 7 wherein said guide members comprise guide rollers having generally vertically oriented roll axes, the guide rollers being laterally spaced apart on the stretcher frame.

9. The combination as set forth in claim 6 wherein said roller means comprises at least two rollers mounted for rotation on the stretcher frame in longitudinally spaced apart positions.

10. The combination as set forth in claim 9 wherein the rollers are generally cylindrical and have roll axes extending generally laterally of the stretcher frame, the rollers being mounted for rotation at each end on the frame, each roller being adapted to simultaneously engage said two sideboard members.

11. The combination as set forth in claim 10 wherein said flat portion of the frame comprises a generally rectangular piece of expanded metal mounted on remaining portions of the frame, and wherein the stretcher further comprises straps for securing the sick or injured person to the stretcher.

12. A stretcher for use in confined areas such as a mine tunnel for transporting sick or injured persons, the stretcher being constructed for mounting on sideboard members of a conveyor structure in the mine tunnel, the stretcher comprising a frame including a generally flat portion for supporting the sick or injured person on the stretcher, at least two generally cylindrical rollers mounted for rotation at each end to the frame for rotation with respect to the frame, the rollers each having a roll axis extending generally laterally of the frame such that the rollers are adapted for rolling engagement with two of said sideboard members to support the frame on said sideboard members so that the stretcher may move translationally over the sideboard members, and at least two generally laterally spaced guide rollers depending from the frame and having generally vertically oriented roll axes, the space between of the guide rollers being sized to receive an upper portion of only a single one of said sideboard members, guide rollers being thereby positioned for engagement with said one sideboard member to retain the rollers in engagement with said sideboard members.

* * * * *